US009105974B2

(12) United States Patent
Zeltser et al.

(10) Patent No.: US 9,105,974 B2
(45) **Date of Patent: *Aug. 11, 2015**

(54) ANTENNA WITH DIVIDED GROUND PLANE

(71) Applicants: Sagiv Zeltser, Tel Aviv (IL); Yohan Cohen, Oranit (IL)

(72) Inventors: Sagiv Zeltser, Tel Aviv (IL); Yohan Cohen, Oranit (IL)

(73) Assignee: Google Inc., Mountain View, CA (US)

( * ) Notice: Subject to any disclaimer, the term of this patent is extended or adjusted under 35 U.S.C. 154(b) by 178 days.

This patent is subject to a terminal disclaimer.

(21) Appl. No.: 13/761,179

(22) Filed: Feb. 7, 2013

(65) Prior Publication Data

US 2013/0154892 A1 Jun. 20, 2013

Related U.S. Application Data

(63) Continuation of application No. 12/786,963, filed on May 25, 2010, now Pat. No. 8,384,612.

(60) Provisional application No. 61/180,894, filed on May 25, 2009.

(51) Int. Cl.

| | |
|---|---|
| ***H01Q 1/48*** | (2006.01) |
| ***H01Q 1/22*** | (2006.01) |
| ***H01Q 1/24*** | (2006.01) |
| ***H01Q 9/30*** | (2006.01) |

(52) U.S. Cl.

CPC ..... *H01Q 1/48* (2013.01); *H01Q 1/2275* (2013.01); *H01Q 1/243* (2013.01); *H01Q 9/30* (2013.01)

(58) Field of Classification Search

CPC ..... H01Q 1/48; H01Q 1/50; H01Q 1/2275

USPC ..... 343/846, 848

See application file for complete search history.

(56) References Cited

U.S. PATENT DOCUMENTS

| | | | |
|---|---|---|---|
| 5,625,673 | A | 4/1997 | Grewe et al. |
| 5,628,055 | A | 5/1997 | Stein |
| 5,809,115 | A | 9/1998 | Inkinen |
| 5,893,037 | A | 4/1999 | Reele et al. |
| 5,907,815 | A | 5/1999 | Grimm et al. |
| 6,188,917 | B1 | 2/2001 | Laureanti |
| 6,201,867 | B1 | 3/2001 | Koike |
| 6,243,578 | B1 | 6/2001 | Koike |
| 6,477,357 | B1 | 11/2002 | Cook |
| 6,516,202 | B1 | 2/2003 | Hawkins et al. |

(Continued)

FOREIGN PATENT DOCUMENTS

| | | | |
|---|---|---|---|
| EP | 1871075 | A1 | 12/2007 |
| WO | 9421058 | A1 | 9/1994 |

(Continued)

*Primary Examiner* — Robert Karacsony

(74) *Attorney, Agent, or Firm* — Soquel Group LLC

(57) ABSTRACT

A removable jacket for a modular communicator, including a connector for connecting the jacket to a modular communicator that includes an antenna and a ground plane for the antenna, wherein the jacket may be conveniently attached to and detached from the communicator, an extended ground plane for the antenna, and at least one ground contact, for connecting the extended ground plane to the ground plane of the communicator, wherein the ground plane of the communicator is too short for the antenna to resonate at a desired frequency, but the ground plane of the communicator when connected with the extended ground plane, provides a combined ground plane sufficient for the antenna to resonate at the desired frequency.

8 Claims, 5 Drawing Sheets

(56) References Cited

U.S. PATENT DOCUMENTS

| | | | | |
|---|---|---|---|---|
| 6,640,113 | B1 | 10/2003 | Shim et al. | |
| 6,690,947 | B1 | 2/2004 | Tom | |
| 6,898,283 | B2 | 5/2005 | Wycherley et al. | |
| 6,907,264 | B1 | 6/2005 | Sterkel | |
| 6,999,792 | B2 | 2/2006 | Warren | |
| 7,085,542 | B2 | 8/2006 | Dietrich et al. | |
| 7,194,285 | B2 | 3/2007 | Tom | |
| 7,266,391 | B2 | 9/2007 | Warren | |
| 7,477,919 | B2 | 1/2009 | Warren | |
| 7,515,937 | B2 | 4/2009 | Lee | |
| 7,602,344 | B2 | 10/2009 | Park et al. | |
| 7,620,436 | B2 | 11/2009 | Krenz et al. | |
| 8,384,612 | B2 * | 2/2013 | Zeltser et al. | 343/848 |
| 2002/0090980 | A1 | 7/2002 | Wilcox et al. | |
| 2002/0151327 | A1 | 10/2002 | Levitt | |
| 2004/0233930 | A1 | 11/2004 | Colby, Jr. | |
| 2004/0268005 | A1 | 12/2004 | Dickie | |
| 2005/0159184 | A1 | 7/2005 | Kerner et al. | |
| 2006/0003804 | A1 | 1/2006 | Liu | |
| 2006/0105722 | A1 | 5/2006 | Kumar | |
| 2006/0190321 | A1 | 8/2006 | Martins Nicho et al. | |
| 2006/0241353 | A1 | 10/2006 | Makino et al. | |
| 2007/0004450 | A1 | 1/2007 | Parikh | |
| 2007/0018957 | A1 | 1/2007 | Seo | |
| 2007/0079030 | A1 | 4/2007 | Okuley et al. | |
| 2007/0161404 | A1 | 7/2007 | Yasujima et al. | |
| 2007/0288583 | A1 | 12/2007 | Rensin et al. | |
| 2008/0009325 | A1 | 1/2008 | Zinn et al. | |
| 2008/0040354 | A1 | 2/2008 | Ray et al. | |
| 2008/0140886 | A1 | 6/2008 | Izutsu | |
| 2008/0252536 | A1 | 10/2008 | Anguera et al. | |
| 2009/0225819 | A1 * | 9/2009 | Nysen et al. | 375/222 |
| 2009/0228608 | A1 * | 9/2009 | Nysen et al. | 710/1 |

FOREIGN PATENT DOCUMENTS

| | | | |
|---|---|---|---|
| WO | 0059247 | A1 | 10/2000 |
| WO | 0186922 | A1 | 11/2001 |
| WO | 03103174 | A1 | 12/2003 |

* cited by examiner

ANTENNA WITH DIVIDED GROUND PLANE

CROSS REFERENCES TO RELATED APPLICATIONS

This application is a continuation of U.S. application Ser. No. 12/786,963, entitled ANTENNA WITH DIVIDED GROUND PLANE, filed on May 25, 2010 by inventors Sagiv Zeltser and Yohan Cohen. U.S. application Ser. No. 12/786,963 claims benefit of U.S. Provisional Application No. 61/180,894, entitled ANTENNA WITH DIVIDED GROUND PLANE, filed on May 25, 2009 by inventors Sagiv Zeltser and Yohan Cohen.

FIELD OF THE INVENTION

The field of the present invention is antennas for wireless communication devices.

BACKGROUND OF THE INVENTION

One of the many challenges in miniaturization of wireless communication devices is the lack of a sufficiently large ground plane for an antenna.

As described in US Publication No. 2008/0252536 A1 to Anguera et al., a conventional antenna set for a portable wireless communication device, such as a cell phone, includes an antenna element and a ground plane. The communication device includes a multi-layer printed circuit board (PCB), one of the layers of which serves as a ground plane for the antenna.

Design of an antenna set is done in conjunction with development of the communication device. Antenna design is based inter alia on form factor of the communication device, PCB layout, and location of different elements, especially metallic elements such as hinges, rails, cables, audio lines, LCD and battery. The antenna set is calibrated by performance testing that recursively tests modifications in the antenna with the hardware and the form factor of the communication device. The antenna set is performance tested in several scenarios, with different hand positionings of the phone and fingers covering the antenna.

In order for the antenna to perform well, in terms of its bandwidth, efficiency and gain, the ground plane must be sufficiently large relative to the wavelengths of the frequencies of operation of the antenna. But as the size of the communication device shrinks, the size of the ground plane is correspondingly reduced, yet the frequencies of operation of the antenna must remain substantially unchanged. As such, performance of the antenna degrades.

SUMMARY OF THE DESCRIPTION

Aspects of the present invention relate to miniature communication devices that use extended ground planes to achieve required antenna performance. An antenna and a first ground plane for the antenna are housed within a modular communication device. A second ground plane, which extends the first ground plane, is housed within a jacket into which the modular communication device is inserted, or to which the modular communication device is attached. Additional extended ground planes may be used, as appropriate.

Embodiments of the present invention include inter alia a tiny communicator module that inserts into or attaches to a variety of different devices, to provide the devices with cell phone, short messaging service (SMS) and other communication functionality. Examples of such devices include cameras, MP3 players, digital picture frames, clocks, and a huge assortment of consumer electronic devices that can all benefit from wireless communication.

There is thus provided in accordance with an embodiment of the present invention a transceiver, including a multi-layer printed circuit board including a layer that serves as a first ground plane, and an antenna for transmitting and receiving radio signals, a second ground plane, and at least one ground contact for connecting the first ground plane and the second ground plane, wherein the first ground plane is too short for the antenna to resonate at a desired frequency, but the first and second ground planes, when connected, provide a combined ground plane sufficient for the antenna to resonate at the desired frequency.

There is additionally provided in accordance with an embodiment of the present invention a modular communicator including an antenna for transmitting and receiving radio waves, a ground plane for the antenna, a power amplifier to amplifying signals received by said antenna, a modem for transmitting and receiving data via the antenna, and at least one ground contact, for connecting the ground plane to an extended ground plane housed within a removable jacket for the modular communicator, wherein the ground plane is too short for the antenna to resonate at a desired frequency, but the ground plane when connected with the extended ground plane, provides a combined ground plane sufficient for the antenna to resonate at the desired frequency.

There is further provided in accordance with an embodiment of the present invention a removable jacket for a modular communicator, including an extended ground plane for an antenna, and at least one ground contact, for connecting the extended ground plane to a ground plane for a communicator that houses the antenna, wherein the ground plane is too short for the antenna to resonate at a desired frequency, but the ground plane when connected with the extended ground plane, provides a combined ground plane sufficient for the antenna to resonate at the desired frequency.

There is yet further provided in accordance with an embodiment of the present invention a communication system, including a modular communicator, including an antenna for transmitting and receiving radio waves, a ground plane for the antenna, a power amplifier to amplifying signals received by the antenna, a modem for transmitting and receiving data via the antenna, and at least one ground contact, for connecting the ground plane to a jacket for the modular communicator, and a removable jacket for the modular communicator, including an extended ground plane for the antenna, wherein the ground plane is too short for the antenna to resonate at a desired frequency, but the ground plane and the extended ground plane, when the modular communicator and the removable jacket are connected, provide a combined ground plane sufficient for the antenna to resonate at the desired frequency.

There is moreover provided in accordance with an embodiment of the present invention a transceiver, including a multi-layer printed circuit board including a layer that serves as a first ground plane, and an antenna for transmitting and receiving radio signals, a second ground plane, and at least one ground contact for connecting the first ground plane and the second ground plane, wherein the first ground plane is too short for the antenna to resonate efficiently, but the first and second ground planes, when connected, provide a combined ground plane that resonates with greater efficiency.

There is additionally provided in accordance with an embodiment of the present invention a modular communicator including an antenna for transmitting and receiving radio waves, a ground plane for the antenna, a power amplifier to amplifying signals received by the antenna, a modem for transmitting and receiving data via the antenna, and at least one ground contact, for connecting the ground plane to an extended ground plane housed within a removable jacket for the modular communicator, wherein the ground plane is too short for the antenna to resonate efficiently, but the ground plane when connected with the extended ground plane, provides a combined ground plane that resonates with greater efficiency.

There is further provided in accordance with an embodiment of the present invention a removable jacket for a modular communicator, including an extended ground plane for an antenna, and at least one ground contact, for connecting the extended ground plane to a ground plane for a communicator that houses the antenna, wherein the ground plane is too short for the antenna to resonate efficiently, but the ground plane when connected with the extended ground plane, provides a combined ground plane that resonates with greater efficiency.

There is yet further provided in accordance with an embodiment of the present invention a communication system, including a modular communicator, including an antenna for transmitting and receiving radio waves, a ground plane for the antenna, a power amplifier to amplifying signals received by the antenna, a modem for transmitting and receiving data via the antenna, and at least one ground contact, for connecting the ground plane to a jacket for the modular communicator, and a removable jacket for the modular communicator, including an extended ground plane for the antenna, wherein the ground plane is too short for the antenna to resonate efficiently, but the ground plane and the extended ground plane, when the modular communicator and said removable jacket are connected, provide a combined ground plane that resonates with greater efficiency.

BRIEF DESCRIPTION OF THE DRAWINGS

The present invention will be more fully understood and appreciated from the following detailed description, taken in conjunction with the drawings in which.

DETAILED DESCRIPTION

Aspects of the present invention relate to a wireless communicator antenna that uses a ground plane that is divided into at least two smaller ground planes, one of which is a component of the communicator and others of which are components of a jacket for the communicator. When the communicator is inserted into or attached to the jacket, the smaller ground planes join to form a combined ground plane for the antenna.

Figure 1:
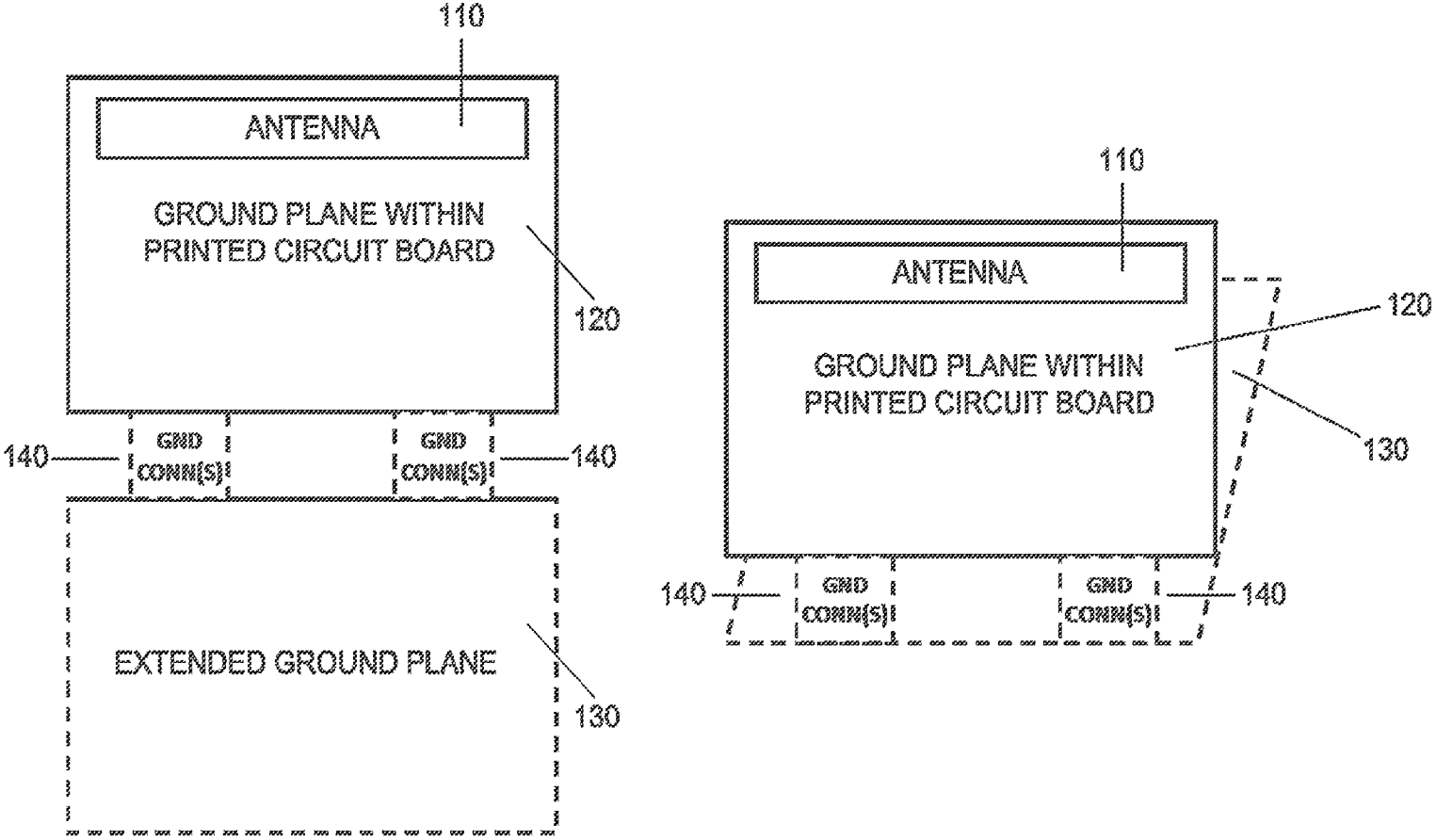
FIG. 1 is a simplified block diagram of two configurations for an antenna with a divided ground plane, in accordance with embodiments of the present invention.

Reference is made to FIG. 1, which is a simplified block diagram of two configurations, 100A and 100B, for an antenna with a divided ground plane, in accordance with embodiments of the present invention. Shown in FIG. 1 is an antenna 110 mounted on a multi-layer printed circuit board (PCB), one layer of which is a ground plane 120. However, the ground plane 120 may not be long enough for antenna 110 to resonate at a desired frequency. An extended ground plane 130 is connected to ground plane 120 via ground contacts 140. The combined ground planes 120 and 130 provide the necessary ground plane length for antenna 110 to resonate at the desired frequency.

Even if ground plane 120 is long enough for antenna 110 to resonate at the desired frequency, the efficiency of the resonance may be low. In this case, ground plane 130 serves to improve the efficiency of the resonance.

In configuration 100A the ground planes 120 and 130 are co-planar, and form a straight combined ground plane. In configuration 100B the ground planes 120 and 130 are skewed, and form a dihedral angle less than 180°.

For each configuration 100A and 100B, empirical tests have been performed on several parameters, as indicated in TABLE I.

TABLE I

Parameter ranges for configurations 100A and 100B

| Parameter | Range |
|---|---|
| Lengths of ground planes 120 and 130 | 20 mm-100 mm |
| Widths of ground contacts 140 | 0 mm-2 mm |
| Lengths of ground contacts 140 | 0 mm-2 mm |
| Number of ground contacts 140 | 1-2 |
| Gap between ground contacts 140 | 0 mm-14 mm |

Figure 2:
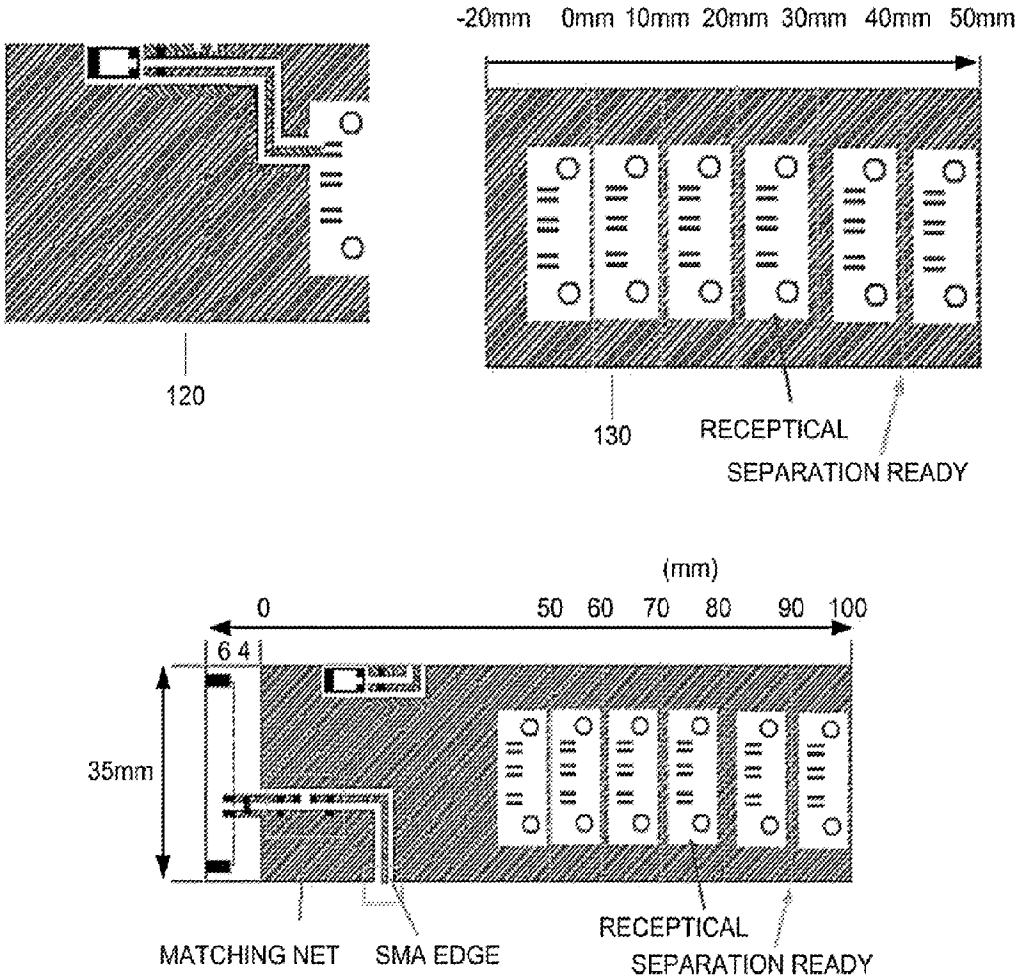
FIG. 2 is a simplified diagram of a printed circuit board with an antenna that uses a divided ground plane, in accordance with an embodiment of the present invention.

Reference is made to FIG. 2, which is a simplified diagram of a printed circuit board with an antenna that uses a divided ground plane, in accordance with an embodiment of the present invention.

Aspects of the present invention relate to a modular wireless communicator that inserts into or attaches to a "jacket". A jacket is defined herein to mean a component that the communicator inserts into or attaches to, and thereby extends the surface of the antenna to improve its functionality. A jacket may be a device that provides an enhanced user interface for the communicator. A jacket may be a device that enriches the capabilities of the communicator. A jacket may or may not be able to operate independently when the communicator is not connected thereto.

In accordance with an embodiment of the present invention, antenna 110 and ground plane 120 are housed within the communicator, and extended ground plane 130 is housed within the jacket. As such, when the communicator is inserted into or attached to the jacket, antenna 110 is able to operate in conjunction with the combined ground plane.

Ground contacts 140 may be embedded within connectors of the communicator and the jacket. Ground contacts 140 may alternatively be embedded within shieldings of such connectors. Ground contacts 140 may yet alternatively be embedded at any other dedicated contact points between the communicator and the jacket, including inter alia metal springs and protrusions. Ground contacts 140 may yet alternatively be embedded at any other mechanical contact that is made when the communicator is inserted into or attached to the jacket.

In some embodiments of the present invention, close proximity yields electromagnetic contact between the ground planes via capacitive coupling, without the need for physical contact.

Figure 3:
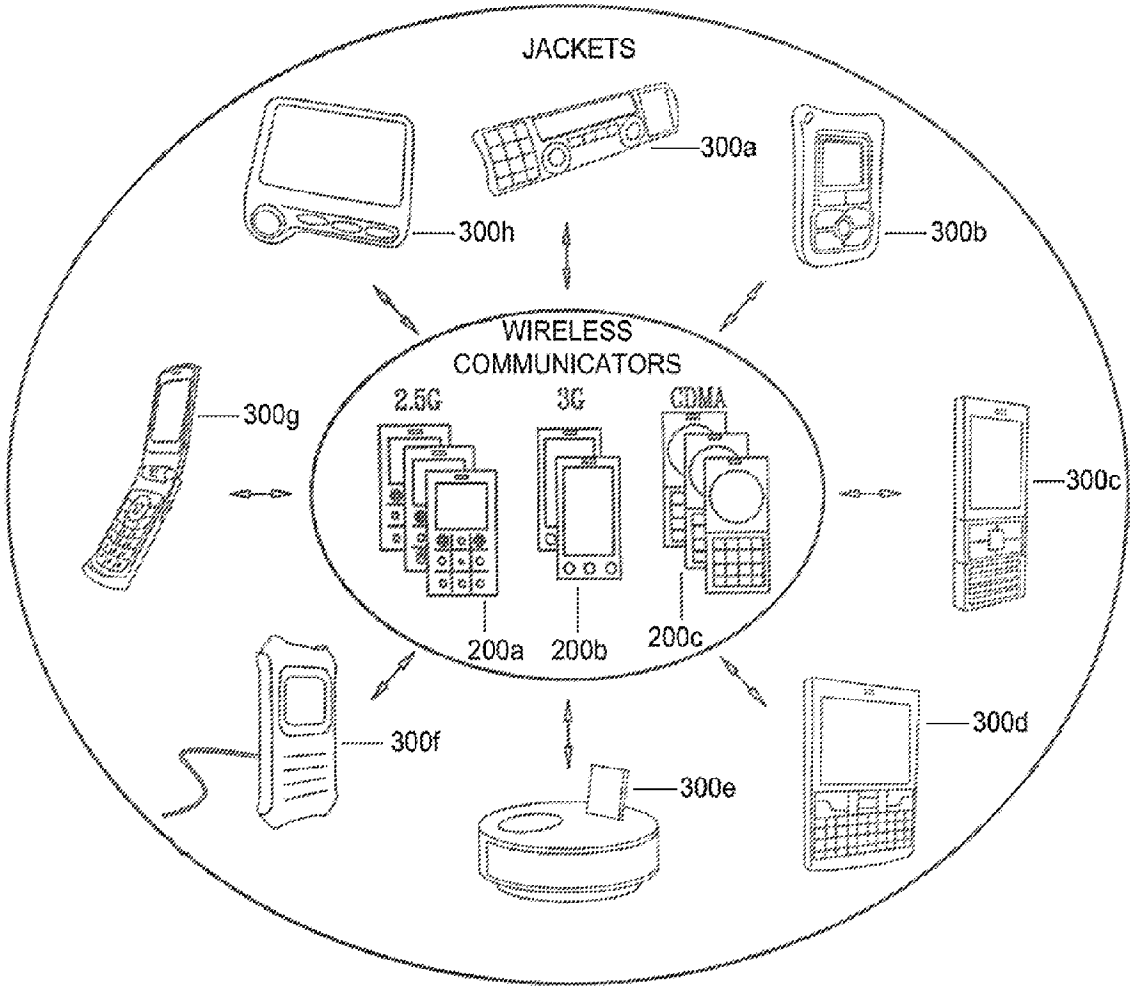
FIG. 3 is an illustration of a communication system constructed and operative in accordance with an embodiment of the present invention.

Reference is made to FIG. 3, which is an illustration of a communication system constructed and operative in accordance with an embodiment of the present invention. Shown in FIG. 3 are a plurality of modular wireless communicators 200*a*-200*c*, including 2.5G cell phones for a GSM network, 3G cell phones for GSM network, and CDMA cell phones for a CDMA network. It will be appreciated by those skilled in the art that the networks illustrated in FIG. 3 are exemplary of a wide variety of networks and communication protocols that are supported by the modular communicators of the present invention, such networks and communication protocols including inter alia WiFi, Bluetooth and WiMax.

Also shown in FIG. 3 is a plurality of jackets 300*a*-300*h*. In accordance with an embodiment of the present invention, each communicator 200*a*-200*c* may be inserted into or attached to any of jackets 300*a*-300*h*, so as to operate in combination therewith. Communicators 200*a*-200*c* are substantially of the same form factor and, as such, are able to be inserted into each of jackets 300*a*-300*h*.

Figure 4:
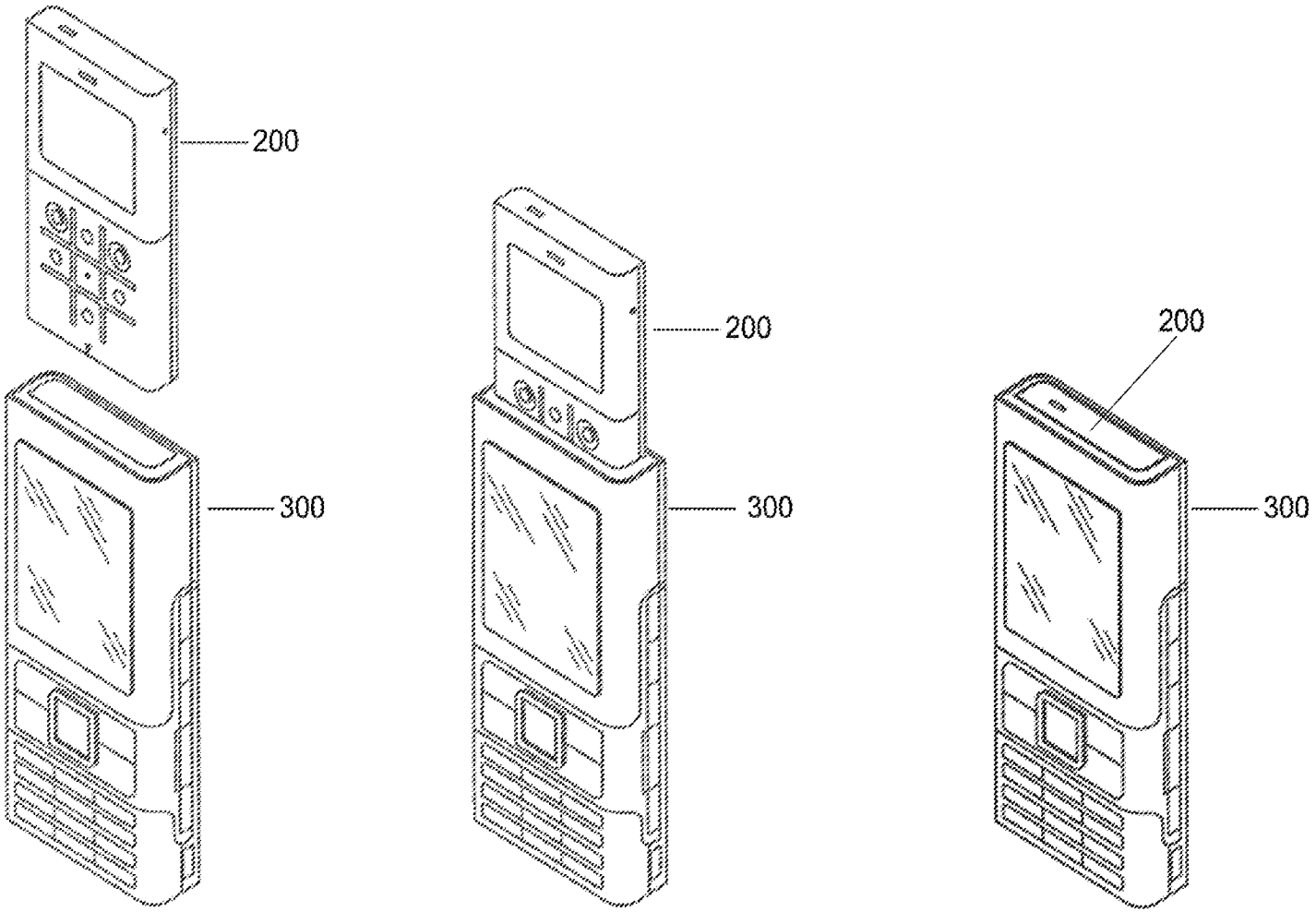
FIG. 4 is an illustration of a modular communicator being inserted into a jacket, in accordance with an embodiment of the present invention.

Reference is further made to FIG. 4, which is an illustration of a modular communicator 200 being inserted into a jacket 300, in accordance with an embodiment of the present invention. Jacket 300 as shown in FIG. 3 includes a hollow cavity at the top for insertion of communicator 200 therein.

Figure 5:
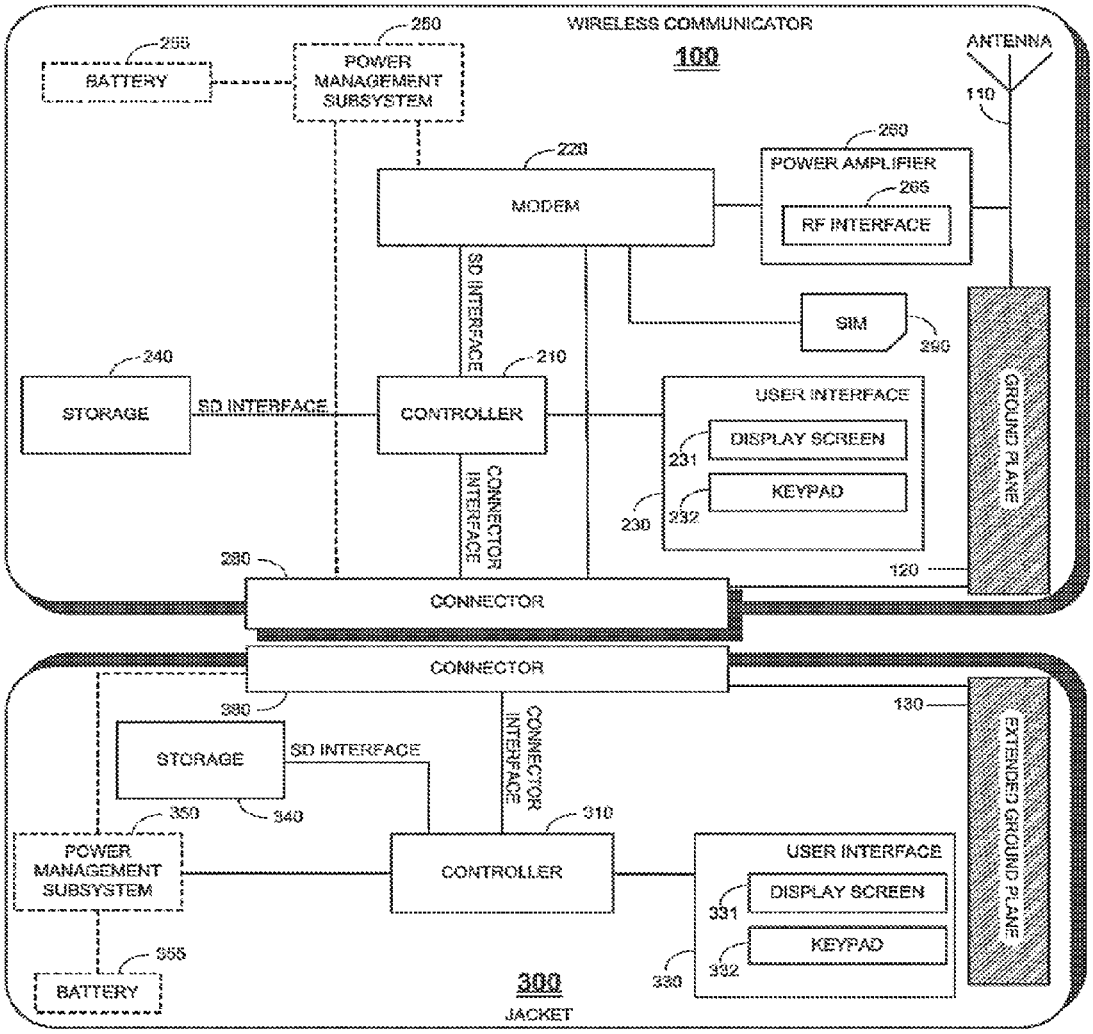
FIG. 5 is a simplified block diagram of a modular communicator and a jacket in accordance with an embodiment of the present invention.

Reference is made to FIG. 5, which is a simplified block diagram of communicator 200 and jacket 300 in accordance with an embodiment of the present invention. Communicator 200 includes antenna 110 and ground plane 120. In addition, communicator 200 generally includes seven primary components, as follows: a controller 210, a modem 220 for sending and receiving voice and data, a user interface 230, a memory storage 240, a power amplifier 260, a connector 280 for connecting the communicator to jacket 300 when the communicator is inserted into jacket 300, and a subscriber identification module (SIM) 290.

Controller 210 executes programmed instructions that control the data flow between communicator 200 and jacket 300. Modem 220 controls the communication functionality of communicator 200. User interface 230 includes a display screen 231 and a keypad 232. User interface 230 may optionally include additional components (not shown) such as a microphone, a headset audio jack, an earpiece, a mono speaker or stereo speakers, and a vibrator.

Power amplifier 260 includes a radio frequency (RF) interface 265, and is connected to antenna 110.

In accordance with an embodiment of the present invention, the interface between controller 210 and storage 240, and the interface between controller 210 and modem 220 are both SD interfaces. The interface between controller 210 and connector 280 is a custom interface.

Communicator 200 may also include an optional power management subsystem 250, which includes charging circuitry for charging a battery 255.

In some embodiments of the present invention, communicator 200 may be missing some of the components shown in FIG. 5, such as display screen 231 or keypad 232.

Jacket 300 includes extended ground plane 130, and may include additional extended ground planes, as appropriate. In addition, jacket 300 generally includes four primary components, as follows: a controller 310, a user interface 330, a memory storage 340, and a connector 380 for connecting the jacket to communicator 200 when communicator 200 is inserted into the jacket. Jacket 300 may also include an optional power management subsystem 350 and an optional battery 355.

User interface 330 includes a display screen 331 and a keypad 332. User interface 330 may optionally include additional components (not shown), such as a microphone, a headset audio jack, an earpiece, a mono speaker or stereo speakers, and a vibrator.

In accordance with an embodiment of the present invention, the interface between controller 310 and storage 340 is an SD interface. The interface between controller 310 and connector 380 is a custom interface.

When communicator 200 is inserted into or attached to jacket 300, ground plane 120 and extended ground plane 130 form a combined ground plane for antenna 110.

In the foregoing specification, the invention has been described with reference to specific exemplary embodiments thereof. It will, however, be evident that various modifications and changes may be made to the specific exemplary embodiments without departing from the broader spirit and scope of the invention as set forth in the appended claims. Accordingly, the specification and drawings are to be regarded in an illustrative rather than a restrictive sense.

What is claimed is:

1. A removable jacket for a modular communicator, comprising:

a connector for connecting the jacket to a modular communicator that comprises an antenna and a ground plane for the antenna, wherein the jacket may be attached to and detached from the communicator;

an extended ground plane for the antenna, housed within the jacket; and two ground contacts separated by a gap that is less than 15 mm, for connecting said extended ground plane to the ground plane of the communicator, each ground contact having a length of approximately 6 mm and a width of 2-4 mm, wherein the ground plane of the communicator is too short for the antenna to resonate at a desired frequency, but the ground plane of the communicator when connected with said extended ground plane, provides a combined ground plane sufficient for the antenna to resonate at the desired frequency.

2. The removable jacket of claim 1 further comprising:

at least one additional extended ground plane, housed within the jacket; and at least one additional ground contact for connecting said at least one additional extended ground plane with said extended ground plane or with the ground plane of the communicator, wherein the ground plane of the communicator, when connected with said extended ground plane and with said at least one additional extended ground plane, provides a combined ground plane sufficient for the antenna to resonate at the desired frequency.

3. The transceiver of claim 1 wherein said ground contacts are embedded in said connector.

4. The removable jacket of claim 1 wherein said extended ground plane, when connected with the ground plane of the communicator, is oriented such that the ground plane and said extended ground plane form a dihedral angle of less than 180°.

5. The removable jacket of claim 1 wherein said extended ground plane, when connected with the ground plane of the communicator, is oriented such that the ground plane and said extended ground plane are co-planar.

6. The removable jacket of claim 1 wherein said extended ground plane is 20-100 mm long.

7. The removable jacket of claim 1 wherein the desired frequency is in the range 800 MHz-1 GHz.

8. The removable jacket of claim 1 wherein the desired frequency is in the range 1.7 GHz-2.2 GHz.

* * * * *